US006401790B1

(12) United States Patent
Dai et al.

(10) Patent No.: US 6,401,790 B1
(45) Date of Patent: Jun. 11, 2002

(54) MAGNETIC DUAL GLASSES WINDOW STRUCTURE

(75) Inventors: Lin Jun Dai; Wei Chen, both of Azusa, CA (US)

(73) Assignee: Q.S.M. Enterprise, Inc., Azusa, CA (US)

( * ) Notice: Subject to any disclaimer, the term of this patent is extended or adjusted under 35 U.S.C. 154(b) by 0 days.

(21) Appl. No.: 09/877,538

(22) Filed: Jun. 9, 2001

(51) Int. Cl.[7] ..... E06B 9/264

(52) U.S. Cl. ..... 160/107; 160/176.1 R; 49/64

(58) Field of Search ..... 160/107, 176.1 R, 160/176.1 P, 176.1 V, 177 R, 177 V; 49/61, 63, 64

(56) References Cited

U.S. PATENT DOCUMENTS 3,253,644 A * 5/1966 Gotoh et al. ..... 160/107
4,685,502 A * 8/1987 Spangenberg ..... 160/107
6,059,006 A * 5/2000 Rossini ..... 160/107
6,065,524 A * 5/2000 Rossini ..... 160/107

* cited by examiner

*Primary Examiner*—David M. Purol
(74) *Attorney, Agent, or Firm*—Raymond Y. Chan; David and Raymond Patent Group

(57) ABSTRACT

A magnetic dual glasses window structure includes a window blind, provided between two panes of glass, including tilt cords for supporting a plurality of slats and an operating system which includes a shaft attached to the tilt cords and a magnetic actuating device. The magnetic actuating device includes an actuating cord movably and encirclingly attaching to two end portions of the shaft, a pair of resilient elements attached to the actuating cord respectively for applying an urging force against the actuating cord, a magnetic seat connecting between the two resilient elements and positioned adjacent an inner surface of one of the panes of glass, and a magnetic slider positioned adjacent an outer surface of the pane of glass for magnetically driving the magnetic seat to move. Therefore, by sliding the magnetic slider, the actuating cord drives the shaft to rotate for controlling the tilt angle of each of the slats.

20 Claims, 3 Drawing Sheets

MAGNETIC DUAL GLASSES WINDOW STRUCTURE

BACKGROUND OF THE PRESENT INVENTION

1. Field of Invention

The present invention relates to a dual glasses window structure, and more particularly to a magnetic dual glasses window structure which comprises a plurality of slats and an operating system adapted for operatively controlling a tilt angle of each of the slats by means of magnetic attraction.

2. Description of Related Arts

It is well known that wall window or door window with double panes of glass provides better heat and sound insulation than a single pane of glass, so that they are widely used in the window structure of wall window and door window. Moreover, for window sheltering purpose, a venetian blind can be provided between the two panes of glass. Generally, the venetain blind comprises a traverse supporter adapted to affix to a ceiling, a slider track mounted on a bottom of the traverse supporter, and a plurality of blades horizontally and suppendedly mounted by tilt cords respectively in such a manner that by operating an operation system, the blades are slid in a vertical movable manner to adjust their tilt angle at the same time.

However, the venetain blind has several drawbacks. In order to operate the venetain blind, a through slot must be provided on one of the panes of glass for communicating with an exterior thereof such that the operation system is adapted for extending through the through slot to actuate the blades of the venetain blind. However, the through slot may destroy the entire structure of the double panes of glass so as to reduce the insulation purpose thereof.

An improved venetain blind is provided between double panes of glass in an airtight manner wherein the operation system comprises a shaft rotatably attached to the tilt cords, a nut with a magnet attached thereto movable mounted on a double helix threaded portion of the shaft and is adjacent an inside surface of one glass pane, and a position slide with attached magnet placed on an outer surface of the glass pane opposite the nut. In which, by magnetically attraction the position slide drives the nut to slidably move along the shaft from one side to another side thereof so as to rotate the shaft. So, rotation of the shaft winds and unwinds the tilt cords to adjust the tilt angle of the blades at the same time.

However, such improved venetian blind has a major drawback that a lubricant is needed to provide between the contacting surfaces of the nut and the shaft, so as to reduce the friction therebetween. The nut will be stuck on the shaft over a period of continued use while the lubricant is dried out. However, it is unable to apply additional lubricant onto the shaft since the venetian blind is mounted between the two panes of glass in the airtight manner unless the user destroy the structure of the double glasses window.

SUMMARY OF THE PRESENT INVENTION

A main object of the present invention is to provide a magnetic dual glasses window structure which comprises a window blind having a plurality of slats and an operating system adapted for controlling a tilt angle of each of the slats by means of magnetic attraction.

Another object of the present invention is to provide a magnetic dual glasses window structure wherein a magnetic actuating device of the operating system comprises a pair of resilient elements for applying an urging force to actuate the operating system. In other words, no additional lubricant is needed to minimize the friction of the operating system so as to prolong the service life span of the window blind.

Another object of the present invention is to provide a magnetic dual glasses window structure wherein the window blind does not require to change the original structural design of the dual glasses window structure, so as to minimize the manufacturing cost of incorporating the window blind with the conventional dual glasses window structure Accordingly, in order to accomplish the above objects, the present invention provides a magnetic dual glasses window structure which comprises two panes of glass spacedly mounted on a window frame and a window blind provided between the two panes of glass, wherein the window blind comprises:

- a top traverse supporter adapted for affixing to a top beam of the window frame;
- a base member;
- a plurality of slats;
- a blind supporting system having tilt cords for spacedly and suspendedly supporting the slats horizontally between the traverse supporter and the base member;
- an operating system comprising a shaft, which is transversely supported in the top traverse supporter in a rotatable manner, having two ends attached with the tilt cords respectively and a magnetic actuating device for driving the shaft to rotate so as to control a tilt angle of each of the slats, wherein the magnetic actuating device comprises an actuating cord movably and encirclingly attaching to two end portions of the shaft, a pair of resilient elements attached to two ends of the actuating cord respectively for applying an urging force against the actuating cord, a magnetic seat connecting between the two resilient elements and positioned adjacent to an inner surface of one of the panes of glass, and a magnetic slider positioned adjacent to an outer surface of the pane of glass for magnetically driving the magnetic seat to move in such a manner that the actuating cord drives the shalt to rotate for controlling the tilt angle of each of the slats.

DETAILED DESCRIPTION OF THE PREFERRED EMBODIMENT

Figure 1:
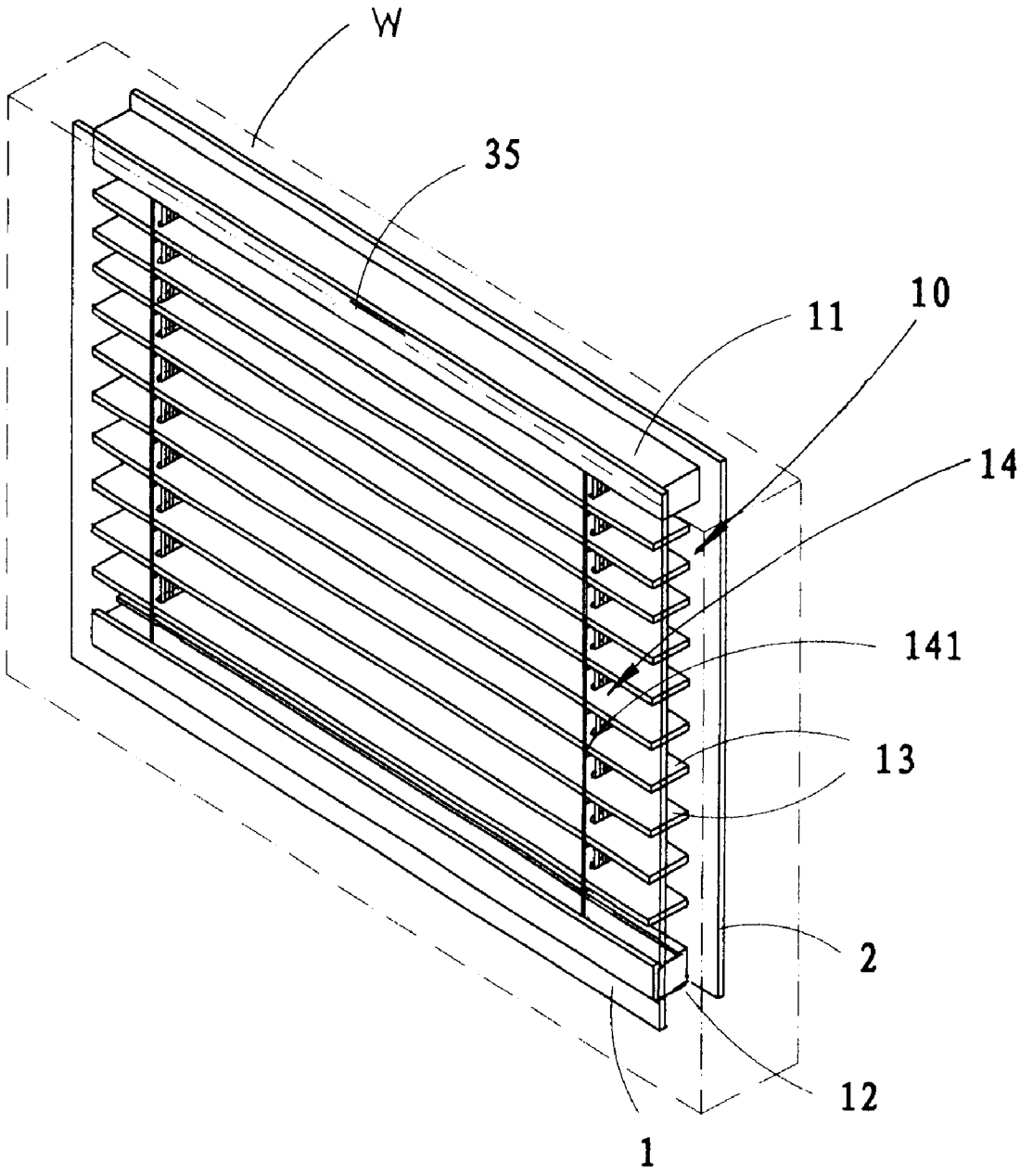
FIG. 1 is a perspective view of a magnetic dual glasses window structure according to a preferred embodiment of the present invention.

Referring to FIG. 1 of the drawings, a magnetic dual glasses window structure according to a preferred embodiment of the present invention is illustrated. The magnetic dual glasses window structure comprises two panes of glass 1, 2 spacedly mounted on a window frame W of a wall window or a door window, and a window blind 10 provided between the two panes of glass 1, 2. The window blind 10 comprises a top traverse supporter 11 adapted for affixing to a top beam of the window frame W, a base member 12, a plurality of slats 13, and a blind supporting system 14 having tilt cords 141 for spacedly and suspendedly supporting the slats 13 horizontally between the traverse supporter 11 and the base member 12.

Figure 2:
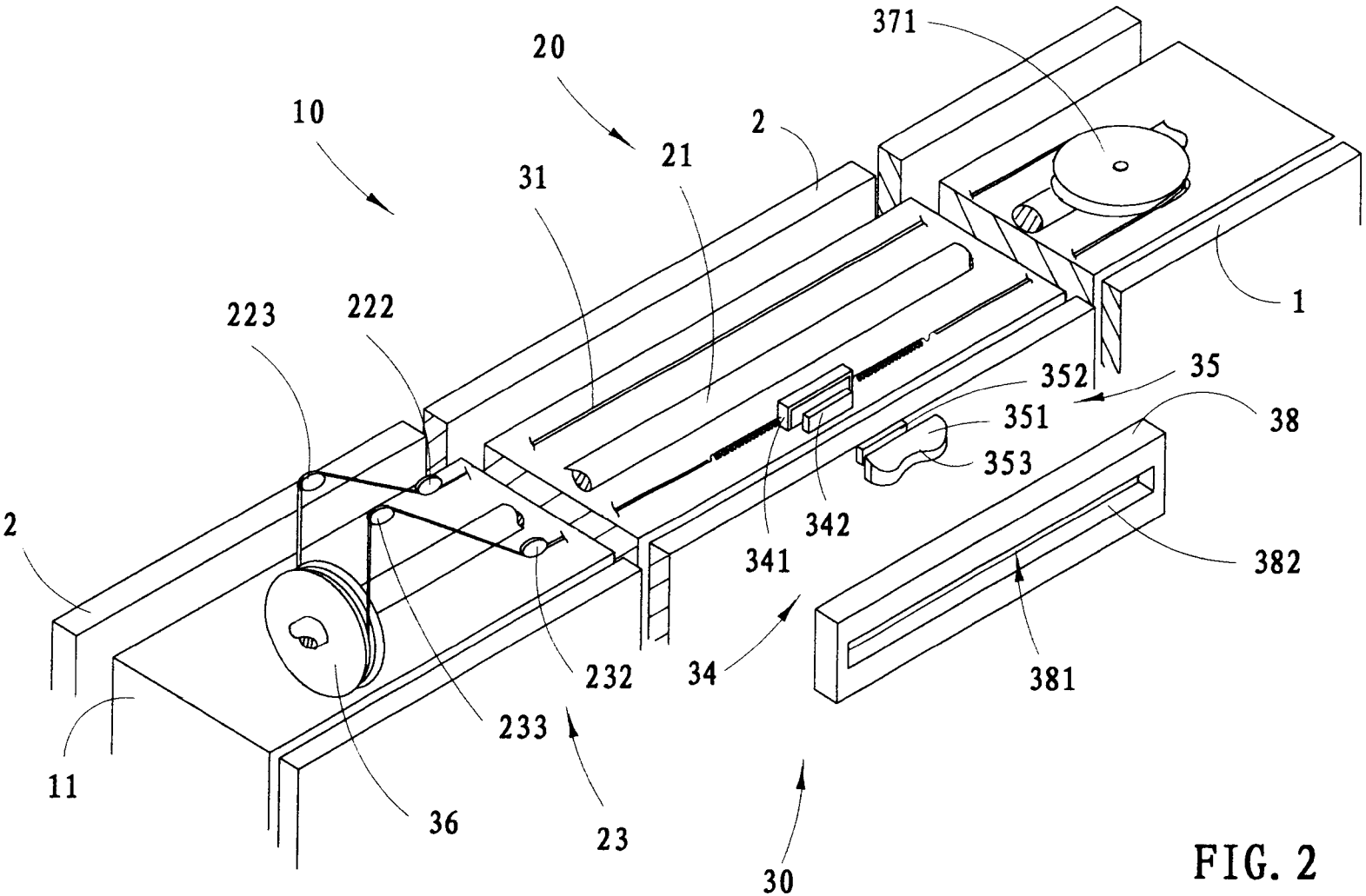
FIG. 2 is a partially exploded perspective view of an operating system of the magnetic dual glasses window structure according to the above preferred embodiment of the present invention.
Figure 3:
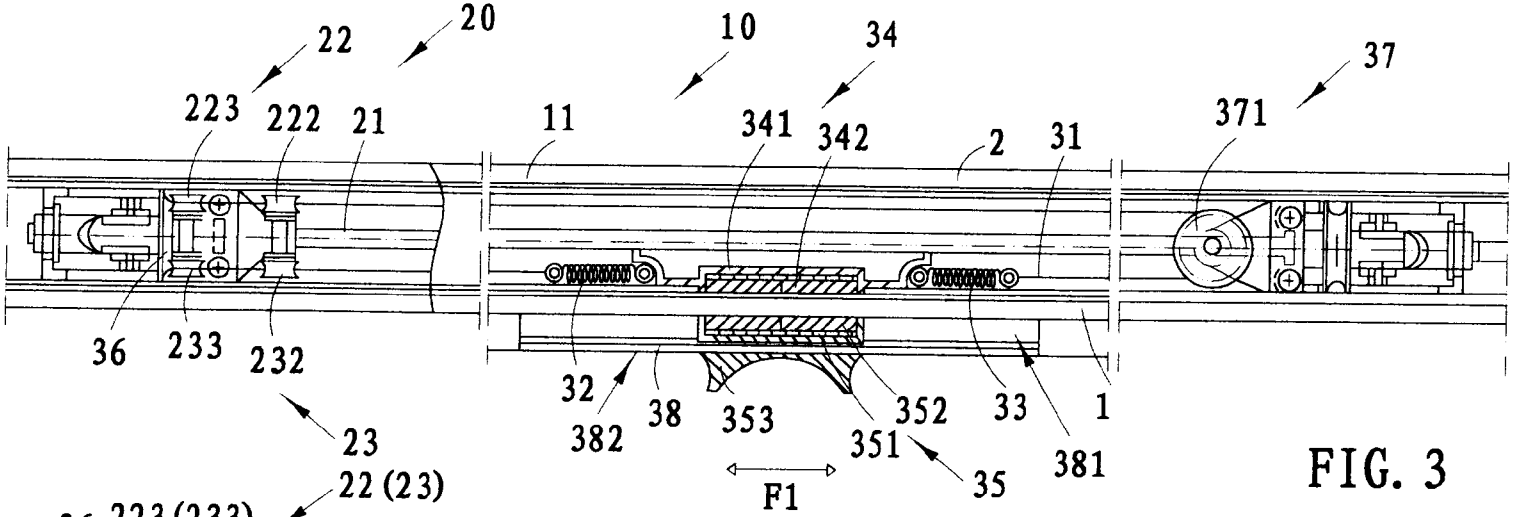
FIG. 3 is a sectional top view of the operating system of the magnetic dual glasses window structure according to the above preferred embodiment of the present invention.
Figure 4:
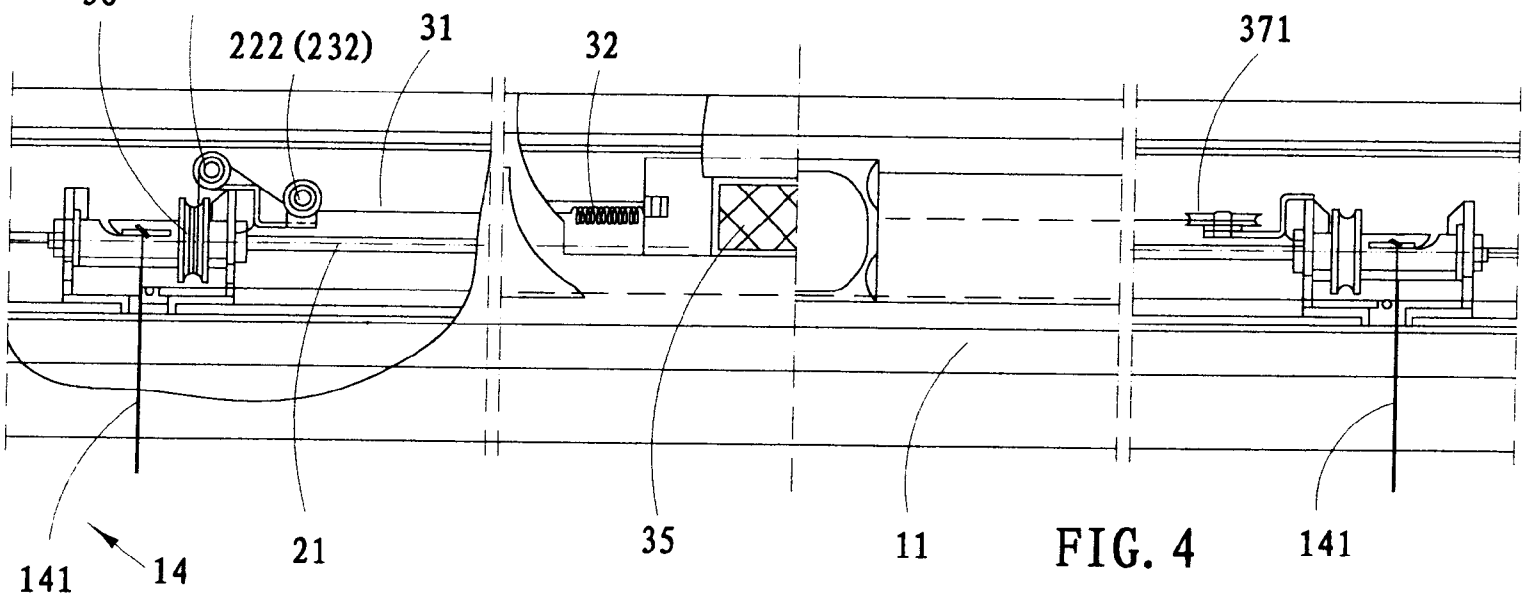
FIG. 4 is a sectional side view of the operating system of the magnetic dual glasses window structure according to the above preferred embodiment of the present invention.

As shown in FIGS. 2 to 4, the window blind 10 further comprises an operating system 20. The operating system 20 comprises a shaft 21, which is transversely and rotatably supported in the top traverse supporter 11 having two ends coupled with the tilt cords 141 respectively, as shown in FIG. 4. The operating system 20 further comprises a magnetic actuating device 30 for driving the shaft 21 to rotate so as to control a tilt angle of each of the slats 13.

The magnetic actuating device 30 comprises an actuating cord 31 movably and encirclingly attaching to two end portions of the shaft 21, a pair of resilient elements 32, 33 attached to two ends of the actuating cord 31 respectively for applying an urging force against the actuating cord 31, a magnetic seat 34 connecting between the two resilient elements 32, 33 and positioned adjacent an inner surface of one of the panes of glass 1, and a magnetic slider 35 positioned adjacent an outer surface of the pane of glass 1 for magnetically driving the magnetic seat 34 to move in such a manner that the actuating cord 31 drives the shaft 21 to rotate for controlling, the tilt angle of each of the slats 13.

According to the preferred embodiment, the magnetic actuating device 30 further comprises a driving pulley 36 coaxially attached to one end portion of the shaft 21 and a rewinding means 37 supported on another end portion of the shaft 21 for rewinding the actuating cord 31 in an opposite direction. The rewinding means 37 comprises a rewinding pulley 371 parallely supported on the shaft 21 in a free rotating manner, wherein the actuating cord 31 is encircling extended between the driving pulley 36 and the rewinding pulley 371 in such a manner that movement of the actuating cord 31 drives the driving pulley 36 to rotate so as to force the shaft 21 to rotate for controlling the tilt angle of each of the slats 13. Since the rewinding pulley 371 is in the free rotating manner, the frictional force between the actuating cord 31 and the rewinding pulley 371 can be minimized.

The magnetic seat 34 comprises a magnet housing 341 provided thereon and a first permanent magnet 342 mounted in the magnet housing 341 with one magnetic pole thereof arranged to face towards the inner surface of the respective pane of glass 1. Preferably, a depth of the magnet housing 341 is equal to a thickness of the first permanent magnet 342 such that the first permanent magnet 342 is fittedly mounted in the magnet housing 341 for sliding along the inner surface of the pane of glass 1.

The magnetic slider 35 comprises a magnet casing 351 provided thereon and a second permanent magnet 352 mounted in the magnet casing 351 with one magnetic pole thereof, which is opposite to the magnetic pole of the first permanent magnet 342, arranged to face towards the outer surface of the respective pane of glass 1 and align with the first permanent magnet 342 of the magnetic seat 24. Due to the magnetically attraction, a movement of the magnetic slider 35 magnetically drives the magnetic seat to slide so as to pull the actuating cord 31 to move.

The magnetic actuating device 30 further comprises a sliding guider 38, which is attached on the outer surface of the respective pane of glass 1, having a slider cavity 381 for the magnetic slider 35 slidably disposed therein and a guider slot 382 having a predetermined length transversely formed on the sliding guider 38, wherein a handle portion 353 of the magnetic slider 35 is slidably extended to an exterior of the sliding guider 38 through the guider slot 382. In other words, a horizontal movement of the magnetic slider 35 is guided by the sliding guider 38 so that a user is able to hold the handle portion 353 of the magnetic slider 35 to slide the magnetic slider 35 along the guider slot 382 of the sliding guider 38. Thus, the length of the guider slot 382 is a distance that the magnetic slider 35 slidably traveled which is adapted for controlling the tilt angle of each of the slats 13 in 180 degrees.

The resilient elements 32, 33, according to the preferred embodiment, are two springs each connecting between the actuating cord 31 and the magnetic seat 34 by connecting a first end to the end of the actuating cord 31 and attaching a second end to the magnetic seat 34, wherein each resilient element 32, 33 applies an urging against the actuating cord 31 to pull the actuating cord 31 to move towards the magnetic seat 34.

The operating system 20 further comprises a pair of guiding means 22, 23 in parallel manner for guiding and reinforcing the actuating cord 31 extended to the driving pulley 36 wherein each of the guiding means 22, 23 comprises a supporting arm 221, 231 supported in the top traverse supporter 11, a lower guiding pulley 222, 232 vertically supported on one end of the supporting arm 221, 231 in a free rotating manner, and an upper guiding pulley 223, 233 vertically supported on another end of the supporting arm 221, 231 in a free rotating manner wherein the actuating cord 31 is detoured downwardly to wind around the driving pulley 36 between the two guiding means 22, 23 through the lower and upper guiding pulleys 222, 232, 232, 233 respectively, as shown in FIG. 4.

In order to operate the window blind 10, a sliding force F1 must be applied on the magnetic slider 35 to slide the magnetic slider 35 horizontally along the guider slot 382. Then, the movement of the magnetic slider 35 will magnetically move the magnetic seat 34 in the same direction. One of the resilient elements 32 is extended while the other resilient element is compressed by the sliding force 11 for providing urging forces against the actuating cord 31, so as to pull and push the actuating cord 31 towards and away to the magnetic seat 34 by the extended and compressed resilient elements 32, 33 respectively. The shaft 21 will be driven to rotate through the driving pulley 36 for controlling the tilt angle of each of the slats 13 at the same time.

It is worth to mention that the actuating cord 31 does not directly moved by the magnetic seat 34 but moved by the urging forces of the resilient elements 32, 33. So, the life service span of the actuating cord 31 will be prolonged by eliminating the pulling directly by the sliding force F1 which will break the actuating cord easily. Thus, the operating system 20 does not require any lubricant to reduce the friction because all the pulleys are in the free rotating manner that less frictional force is produced. Furthermore, the dual glasses window structure does not require changing its original structure that the two panes of glass 1, 2 are mounted in an airtight manner for providing better insulation.

What is claimed is:

1. A magnetic dual glasses window structure which comprises two panes of glass spacedly mounted on a window frame and a window blind provided between said two panes of glass, wherein said window blind comprises:

a top traverse supporter adapted for affixing to a top beam of said window frame;

a base member;

a plurality of slats;

a blind supporting system having tilt cords for spacedly and suspendedly supporting said slats horizontally between said traverse supporter and said base member;

an operating system comprising a shaft, which is transversely and rotatably supported in said top traverse supporter, having two ends attached to said tilt cords respectively and a magnetic actuating device for driving said shaft to rotate so as to control a tilt angle of each of said slats, wherein said magnetic actuating device comprises an actuating cord movably and encirclingly attaching to two end portions of said shaft, a pair of resilient elements attached to two ends of said actuating cord respectively for applying an urging force against said actuating cord, a magnetic seat connecting between said two resilient elements and positioned adjacent to an inner surface of one of said panes of glass, and a magnetic slider positioned adjacent to an outer surface of said another pane of glass for magnetically driving said magnetic seat to move horizontally in such a manner that said actuating cord drives said shaft to rotate for controlling said tilt angle of each of said slats.

2. A magnetic dual glasses window structure, as recited in claim 1, wherein said magnetic seat comprises a magnet housing provided thereon and a first permanent magnet mounted in said magnet housing with one magnetic pole thereof arranged to face towards said inner surface of said respective pane of glass, wherein said magnetic slider comprises a magnet casing provided thereon and a second permanent magnet disposed in said magnet casing with one magnetic pole thereof, which is opposite to said magnetic pole of said first permanent magnet, arranged to face towards said outer surface of said respective pane of glass and to align with said first permanent magnet of said magnetic seat so as to magnetically attract said magnetic seat with said magnetic slider.

3. A magnetic dual glasses window structure, as recited in claim 1, wherein said resilient elements are two springs each connecting between said actuating cord and said magnetic seat by connecting a first end to said end of said actuating cord and attaching a second end to said magnetic seat, wherein each of said resilient elements is adapted for applying an urging against said actuating cord to pull said actuating cord to move towards said magnetic seat.

4. A magnetic dual glasses window structure, as recited in claim 2, wherein said resilient elements are two springs each connecting between said actuating cord and said magnetic seat by connecting a first end to said end of said actuating cord and attaching a second end to said magnetic seat, wherein each of said resilient elements is adapted for applying an urging against said actuating cord to pull said actuating cord to move towards said magnetic seat.

5. A magnetic dual glasses window structure, as recited in claim 1, wherein said magnetic actuating device further comprises a driving pulley coaxially attached to one end portion of said shaft and a rewinding means supported on another end portion of said shaft for rewinding said actuating cord in an opposite direction such that said actuating cord is movably encircling said shaft at said two end portions.

6. A magnetic dual glasses window structure, as recited in claim 2, wherein said magnetic actuating device further comprises a driving pulley coaxially attached to one end portion of said shaft and a rewinding means supported on another end portion of said shaft for rewinding said actuating cord in an opposite direction such that said actuating cord is movably encircling said shaft at said two end portions.

7. A magnetic dual glasses window structure, as recited in claim 4, wherein said magnetic actuating device further comprises a driving pulley coaxially attached to one end portion of said shaft and a rewinding means supported on another end portion of said shaft for rewinding said actuating cord in an opposite direction such that said actuating cord is movably encircling said shaft at said two end portions.

8. A magnetic dual glasses window structure, as recited in claim 5, wherein said operating system further comprises a pair of guiding means arranged in parallel manner for guiding and reinforcing said actuating cord extended to said driving pulley, wherein each of said guiding means comprises a supporting arm supported in said top traverse supporter, a lower guiding pulley vertically supported on one end of said supporting arm in a free rotating manner, and an upper guiding pulley vertically supported on another end of said supporting arm in a free rotating manner, wherein said actuating cord is detoured downwardly to wind around said driving pulley between said two guiding means through said lower and upper guiding pulleys respectively.

9. A magnetic dual glasses window structure, as recited in claim 6, wherein said operating system further comprises a pair of guiding means arranged in parallel manner for guiding and reinforcing said actuating cord extended to said driving pulley, wherein each of said guiding means comprises a supporting arm supported in said top traverse supporter, a lower guiding pulley vertically supported on one end of said supporting arm in a free rotating manner, and an upper guiding pulley vertically supported on another end of said supporting arm in a free rotating manner, wherein said actuating cord is detoured downwardly to wind around said driving pulley between said two guiding means through said lower and upper guiding pulleys respectively.

10. A magnetic dual glasses window structure, as recited in claim 7, wherein said operating system further comprises a pair of guiding means arranged in parallel manner for guiding and reinforcing said actuating cord extended to said driving pulley, wherein each of said guiding means comprises a supporting arm supported in said top traverse supporter, a lower guiding pulley vertically supported on one end of said supporting arm in a free rotating manner, and an upper guiding pulley vertically supported on another end of said supporting arm in a free rotating manner, wherein said actuating cord is detoured downwardly to wind around said driving pulley between said two guiding means through said lower and upper guiding pulleys respectively.

11. A magnetic dual glasses window structure, as recited in claim 1, wherein said magnetic actuating device further comprises a sliding guider, which is attached on said outer surface of said respective pane of glass, having a slider cavity for said magnetic slider slidably disposed therein, and a guider slot which has a predetermined length transversely formed on said sliding guider, wherein a handle portion of said magnetic slider is slidably extended to an exterior of said sliding guider through said guider slot.

12. A magnetic dual glasses window structure, as recited in claim 4, wherein said magnetic actuating device further comprises a sliding guider, which is attached on said outer surface of said respective pane of glass, having a slider cavity for said magnetic slider slidably disposed therein, and a guider slot which has a predetermined length transversely formed on said sliding guider, wherein a handle portion of said magnetic slider is slidably extended to an exterior of said sliding guider through said guider slot.

13. A magnetic dual glasses window structure, as recited in claim 10, wherein said magnetic actuating device further comprises a sliding guider, which is attached on said outer surface of said respective pane of glass, having a slider cavity for said magnetic slider slidably disposed therein, and a guider slot which has a predetermined length transversely formed on said sliding guider, wherein a handle portion of said magnetic slider is slidably extended to an exterior of said sliding guider through said guider slot.

14. A magnetic dual glass window structure, as recited in claim 11, wherein said length of said guider slot equals to a distance that said magnetic slider slidably traveled which is adapted for controlling said tilt angle of each of said slats in 180 degrees.

15. A magnetic dual glass window structure, as recited in claim 12, wherein said length of said guider slot equals to a distance that said magnetic slider slidably traveled which is adapted for controlling said tilt angle of each of said slats in 180 degrees.

16. A magnetic dual glass window structure, as recited in claim 13, wherein said length of said guider slot equals to a distance that said magnetic slider slidably traveled which is adapted for controlling said tilt angle of each of said slats in 180 degrees.

17. A magnetic dual glasses window structure, as recited in claim 5, wherein said rewinding means comprises a rewinding pulley parallely supported on said shaft in a free rotating manner.

18. A magnetic dual glasses window structure, as recited in claim 10, wherein said rewinding means comprises a rewinding pulley parallely supported on said shaft in a free rotating manner.

19. A magnetic dual glasses window structure, as recited in claim 13, wherein said rewinding means comprises a rewinding pulley parallely supported on said shaft in a tree rotating manner.

20. A magnetic dual glasses window structure, as recited in claim 16, wherein said rewinding means comprises a rewinding pulley parallely supported on said shaft in a free rotating manner.

* * * * *